US006676211B1

(12) United States Patent
Figueras Mitjans

(10) Patent No.: US 6,676,211 B1
(45) Date of Patent: Jan. 13, 2004

(54) BLOCK OF SEATS FOR AIRPORTS

(75) Inventor: José Figueras Mitjans, Llica d'Amunt (ES)

(73) Assignee: Figueras International Seating, S.A., Barcelona (ES)

( * ) Notice: Subject to any disclaimer, the term of this patent is extended or adjusted under 35 U.S.C. 154(b) by 0 days.

(21) Appl. No.: 10/070,751

(22) PCT Filed: Apr. 14, 2000

(86) PCT No.: PCT/ES00/00137

§ 371 (c)(1),
(2), (4) Date: Mar. 11, 2002

(87) PCT Pub. No.: WO01/19217

PCT Pub. Date: Mar. 22, 2001

(30) Foreign Application Priority Data

Sep. 13, 1999 (ES) ..... 9902329 U

(51) Int. Cl.[7] ..... A47C 1/12
(52) U.S. Cl. ..... 297/232; 297/440.11; 297/284.2
(58) Field of Search ..... 297/232, 248, 297/284.2, 440.11, 440.1

(56) References Cited

U.S. PATENT DOCUMENTS

| | | | | | |
|---|---|---|---|---|---|
| 3,114,575 | A | * | 12/1963 | Eames et al. | 297/248 |
| 3,640,576 | A | * | 2/1972 | Morrison et al. | 297/440.11 |
| 4,318,570 | A | * | 3/1982 | Adam et al. | 297/450.1 |
| 4,848,843 | A | * | 7/1989 | Gibbs | 297/440.22 |
| 5,318,348 | A | * | 6/1994 | Hess | 297/440.11 |
| 5,762,403 | A | * | 6/1998 | Robinson | 297/440.11 |
| 6,030,040 | A | * | 2/2000 | Schmid et al. | 297/284.2 |
| D441,211 | S | * | 5/2001 | Mitjans | D6/381 |
| 6,293,624 | B1 | * | 9/2001 | Gaylord et al. | 297/440.11 |

* cited by examiner

*Primary Examiner*—Peter R. Brown
(74) *Attorney, Agent, or Firm*—Nath & Associates PLLC; Gary M. Nath; Lee C. Heiman

(57) ABSTRACT

Improved block of seats for airports, having a bearing structure (1), on which a cover (2) is incorporated which determines the consecutive surfaces of the seats and backrests, where each section of the cover (2) is made up of a laminar structure (7) that is assembled between a pair of profiles (6), which are fastened with respect to the bearing structure (1) by means of fittings (5) which in the assembly establish a positioning of the profiles (6) determining a tightening of the laminar structures (7).

6 Claims, 13 Drawing Sheets

BLOCK OF SEATS FOR AIRPORTS

In order to alleviate the waiting time passengers usually have to bear at airports, seat blocks are provided in which the elements of simplicity, capacity, and comfort are appropriately combined within the practical utility of their use.

In this sense, a block of seats is provided according to the present invention, which are particularly dedicated to that function at airports, although obviously their application extends to any place where they have practical use. The inventive block of seats is developed according to features in their construction and assembly, and in their ergonomics in later use, which makes them particularly advantageous.

The inventive block of seats is made up of a bearing structure having a plurality of supports in the form of legs, on which two longitudinal beams are fastened, to which is securely fixed, by means of a plurality of fasteners, an angular cover made up of sections which constitute consecutive seating surfaces in combination with their respective back surfaces.

The cover sections can be made up of planks of wood or metal. In a preferred embodiment, each seat section is made up of side profiles of extruded aluminum, to which laminar structures are attached. A laminar structure is made up of a braided core material covered with synthetic material, with a layer of soft material inside. The braided core material is attached at each of two side edges to a PVC rib. The cover sections are connected to the side by means of sliding into grooved recesses in said profiles.

The fastening assembly on the bearing structure is made up of two parts, one of which is fastened to a longitudinal beam of the bearing structure and the other is fastened to a profile. The two parts have reciprocal connection forms and include a tensile screw assembly. The reciprocal connection forms permit the establishment of a guiding effect, which in turn permits an appropriate stretching of the laminate structure of the cover sections, by traction on the side edges of the core of the laminar structures between profiles.

In this way, a block of seats is obtained whose structure is very easy to assemble and in which the resistance, functionality, and design are combined in a way to produce preferable characteristics for the application for which it is to be used.

Figure 1:
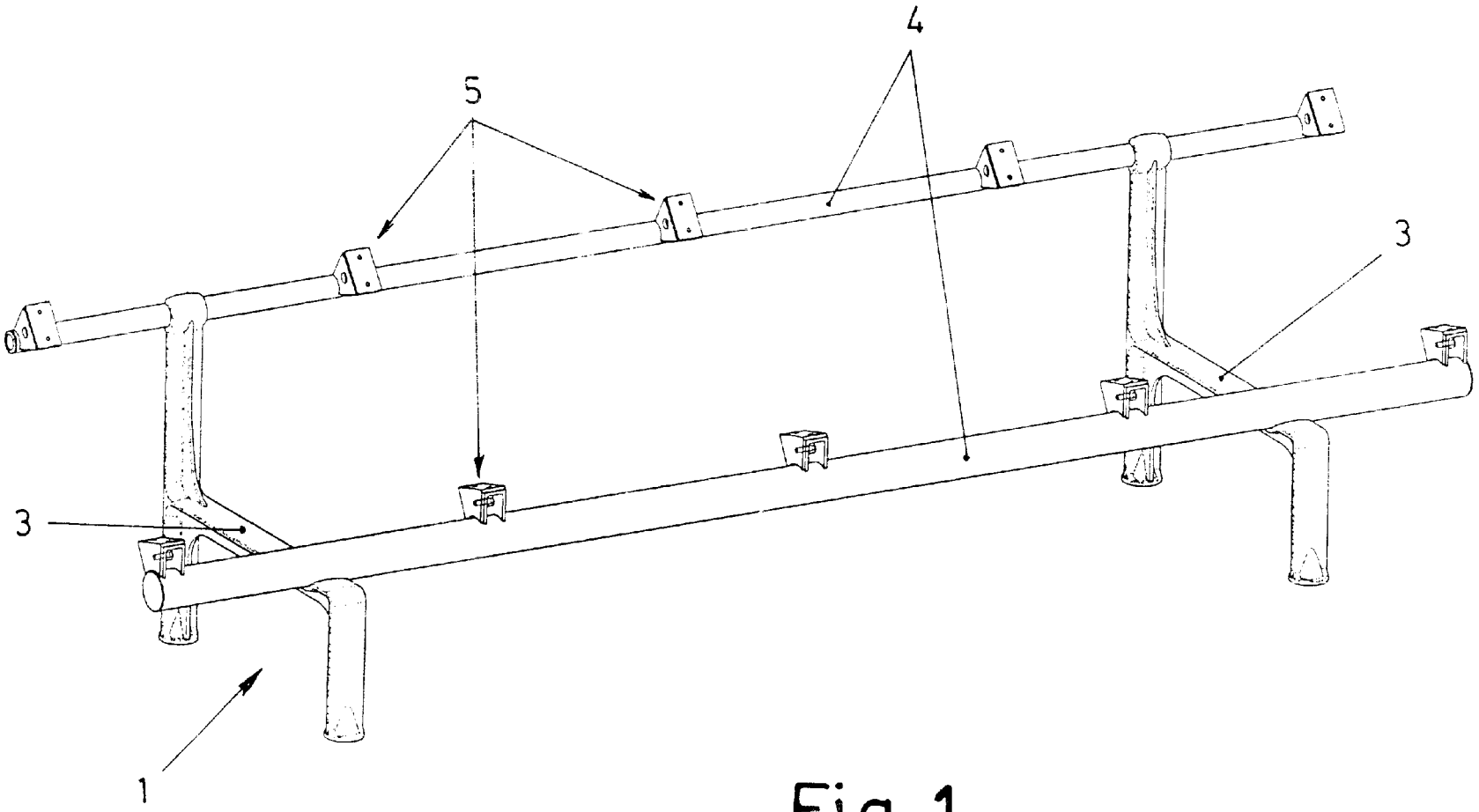
FIG. 1 is a drawing which depicts a front perspective view of the bearing structure of the inventive block of seats.
Figure 2:
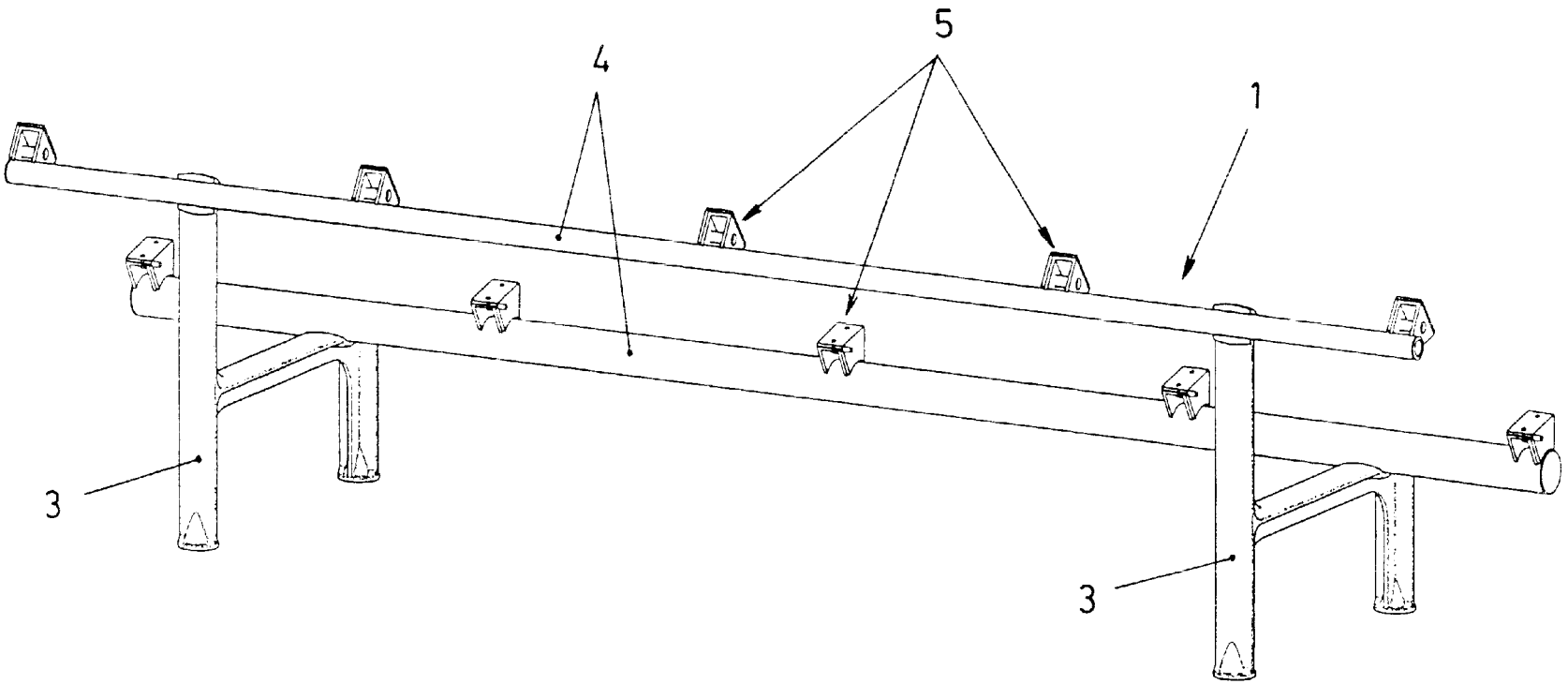
FIG. 2 is a drawing which depicts a back perspective view of the bearing structure of the inventive block of seats.
Figure 3:
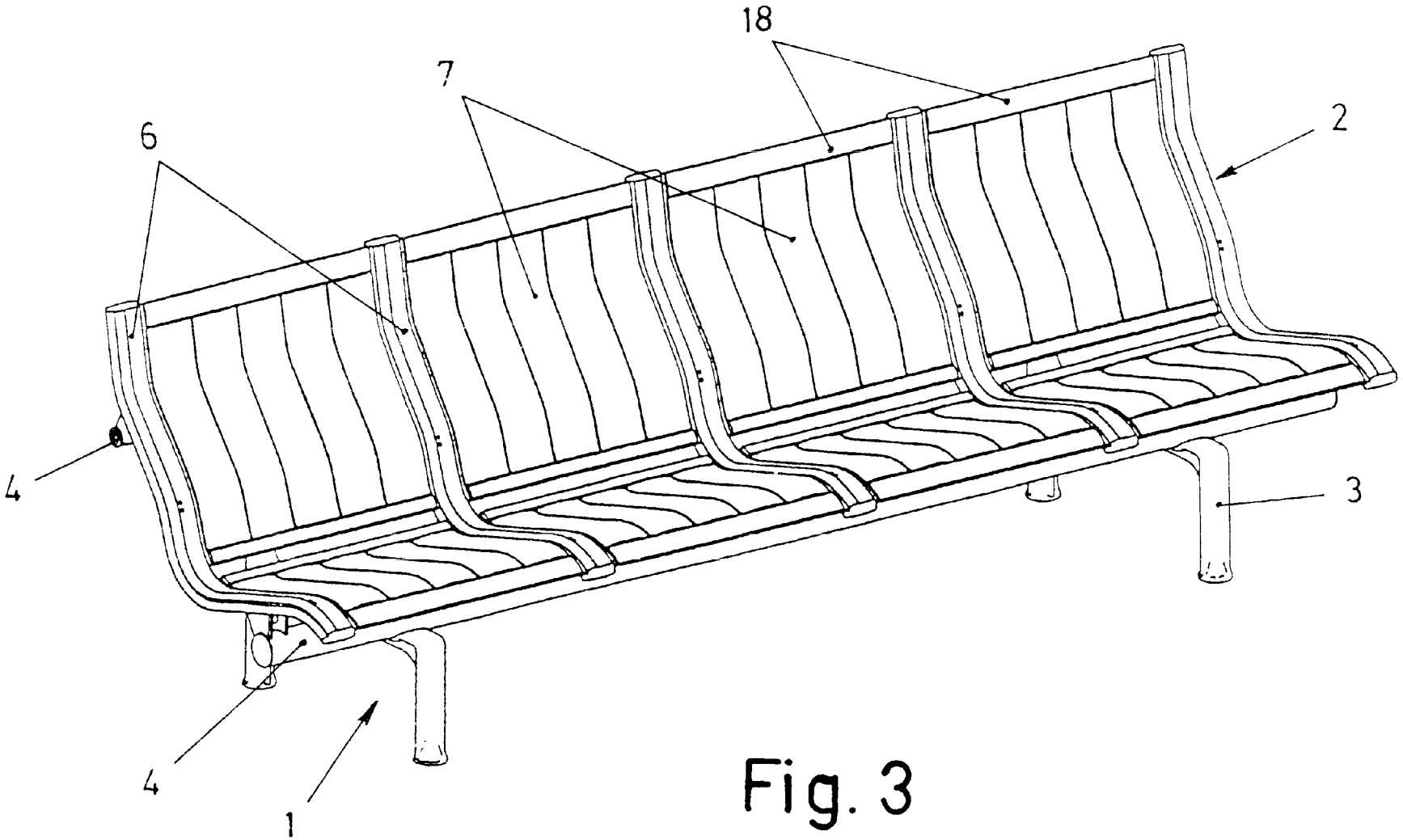
FIG. 3 is a drawing which depicts a front perspective view of a complete block of seats according to the present invention.
Figure 4:
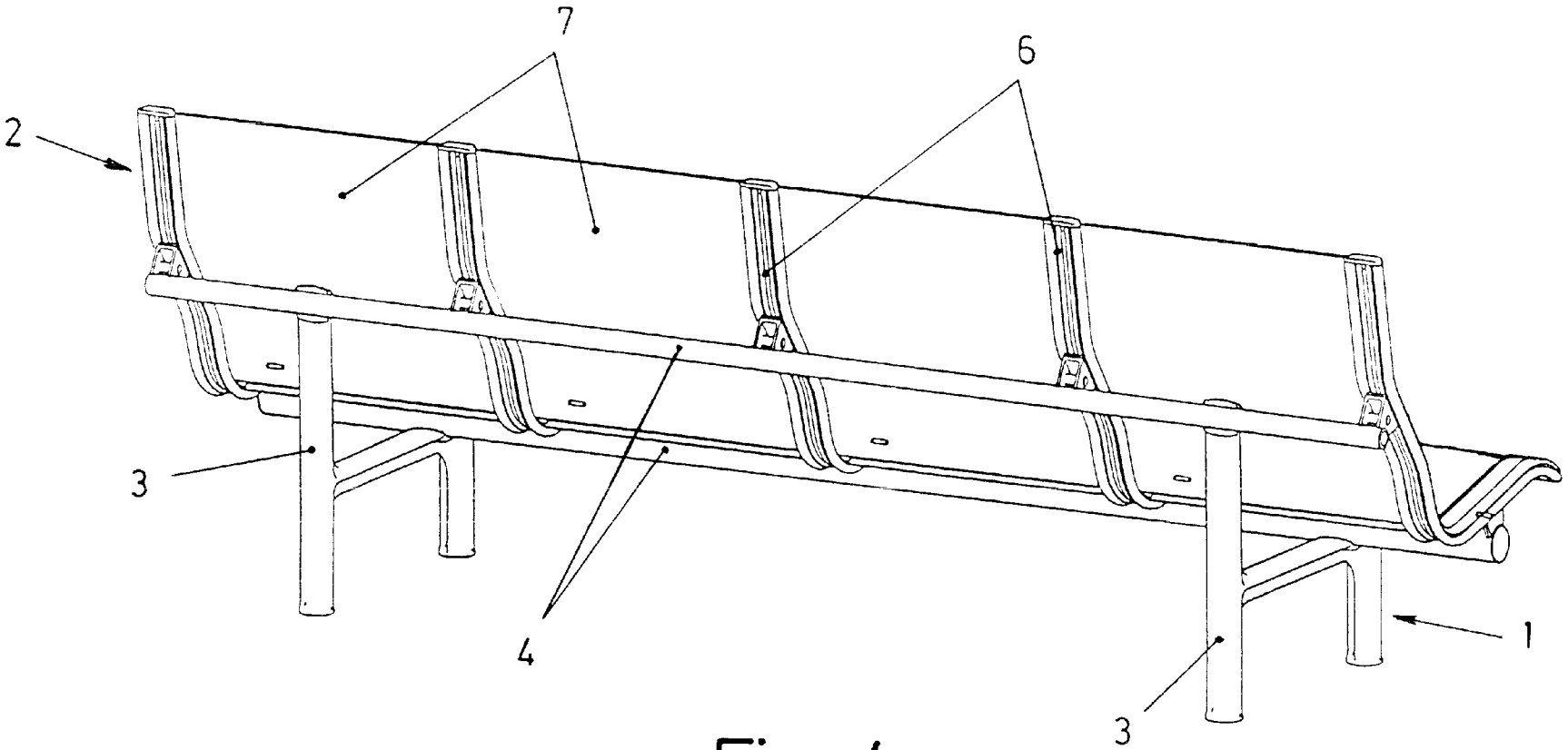
FIG. 4 is a drawing which depicts a back perspective view of a complete block of seats according to the present invention
Figure 5:
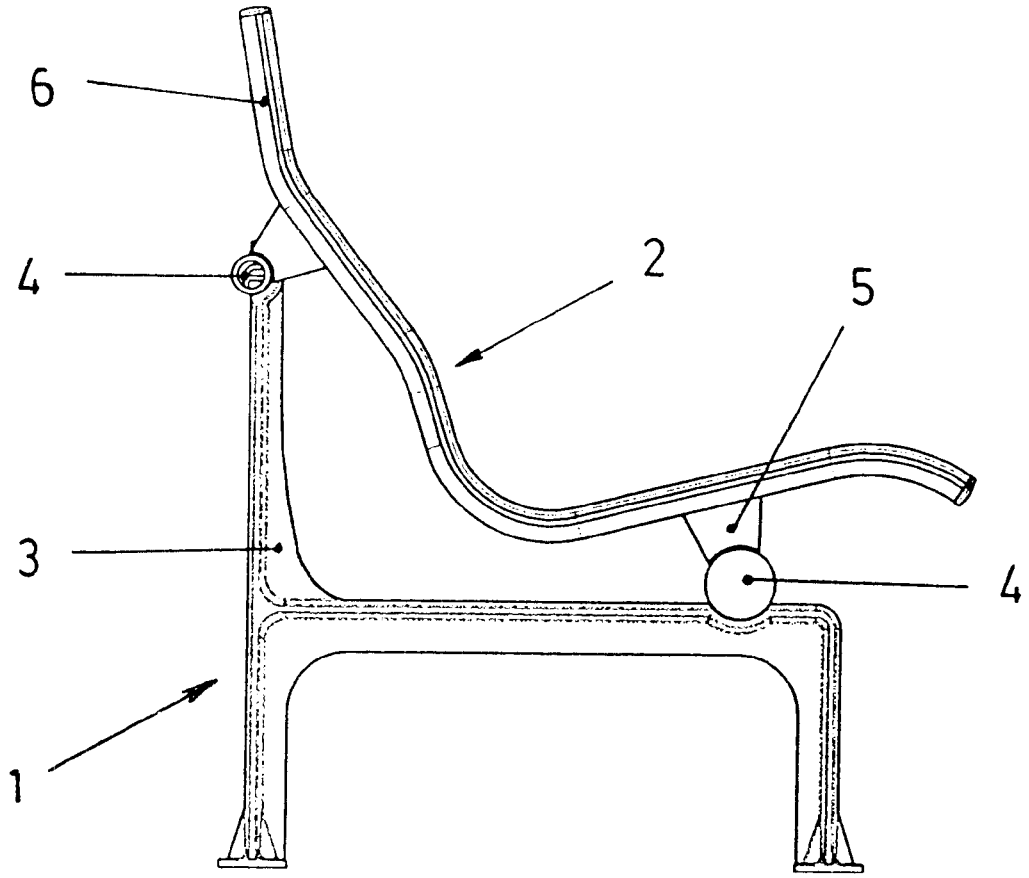
FIG. 5 is a drawing which depicts a view in profile of the inventive block of seats.

The object of the invention is a block of seats, to be used in airports and similar places, to relieve people during the waiting time they usually have to undergo.

The inventive block of seats is made up of a bearing structure (1), on which an angular cover (2) is situated which determines a series of consecutive correlated seating surfaces and back surfaces.

The bearing structure (1) includes a plurality of supports (3) as legs, on which two horizontal longitudinal beams (4) are fastened, making up among them a rigid and stable structure.

The cover (2) is made up of a series of consecutive sections, determining an angular set which is fixed to the longitudinal beams (4) of the bearing structure (1), fastened by means of fittings (5) made up of two complementary parts fixed on either side to the structure. Each section of the cover (2) is made up of a seat module, which in combination make up the block of seats.

In one aspect, the section components of the cover (2) can be made up by metal, wood or any other adequate material. In a particular and preferable realization, the cover sections are made up of extruded aluminum side profiles (6), between which laminar structures (7) are interposed, and which make up the surface between profiles (6) in the seat and back rest area each of the sections.

Figure 9:
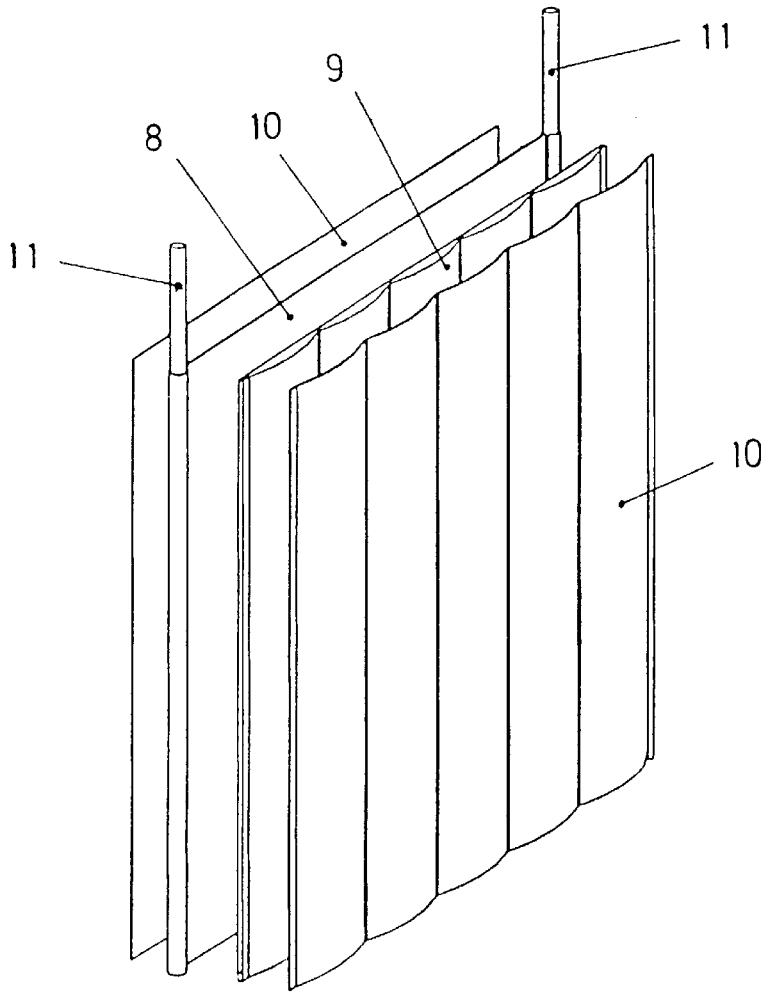
FIG. 9 is a drawing which depicts an exploded perspective view of the laminar structure of a cover section for the block of seats.
Figure 10:
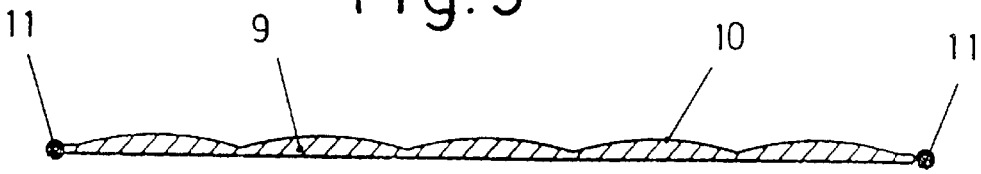
FIG. 10 is a drawing which depicts a view in traverse section of the laminar structure of the cover section.
Figure 11:
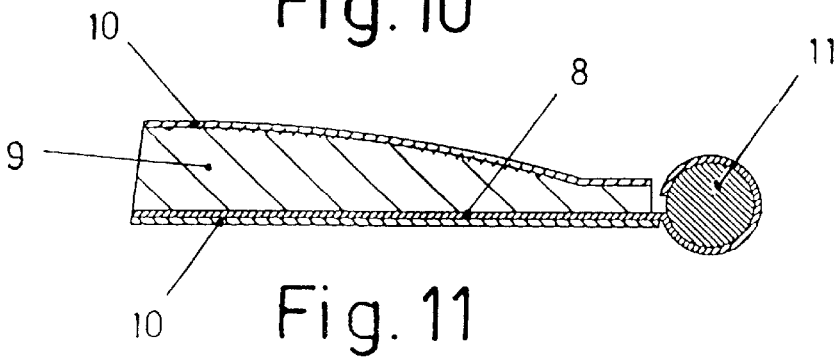
FIG. 11 is a drawing which depicts an enlarged detail of a view in traverse section of the laminar structure of the cover section.

The laminar structures (7) for the surface closure are made up, as represented on FIG. 9, by a braided core (8), a soft layer (9), and a synthetic material covering (10) which covers the structure and gives it the wanted external aspect.

Figure 12:
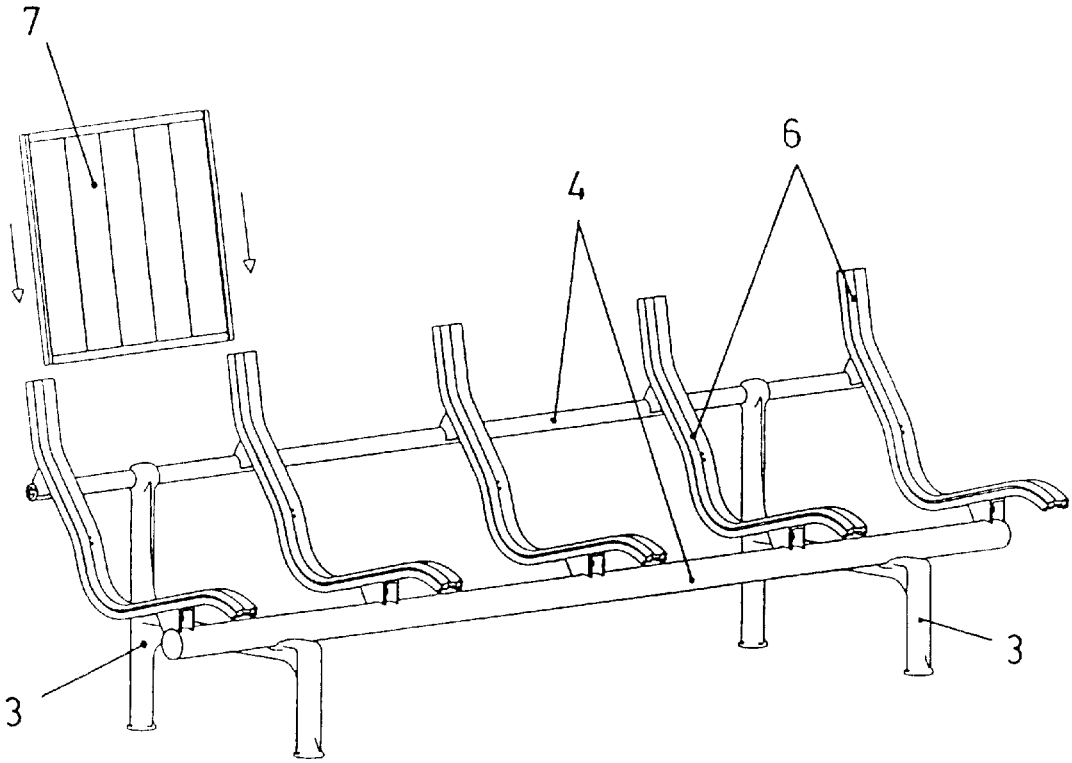
FIG. 12 is a drawing which depicts a perspective view of the assembly of the laminar structure of a cover section between profiles situated on the bearing structure.
Figure 13:
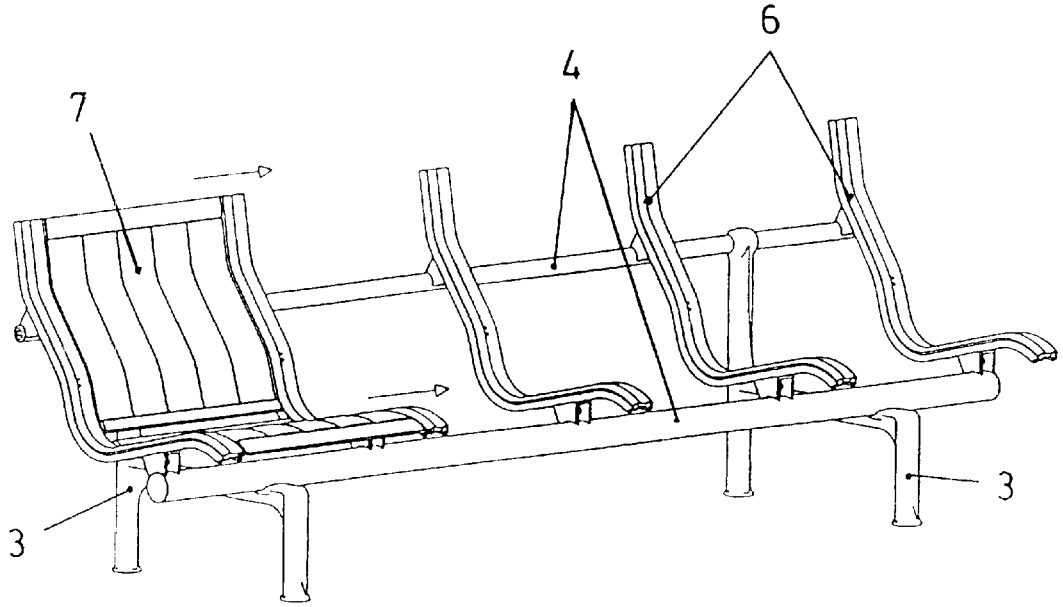
FIG. 13 is a drawing which depicts a perspective view of the laminar structure of a cover section between profiles situated on the bearing structure, with the laminar structure in position.
Figure 14:
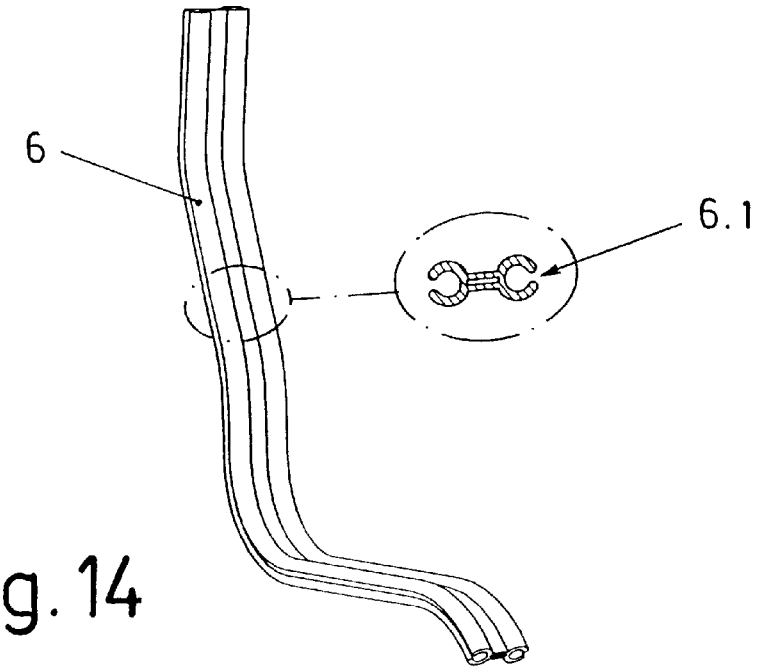
FIGS. 14 and 15 are drawings which depict two non-limiting examples of profile configurations.
Figure 15:
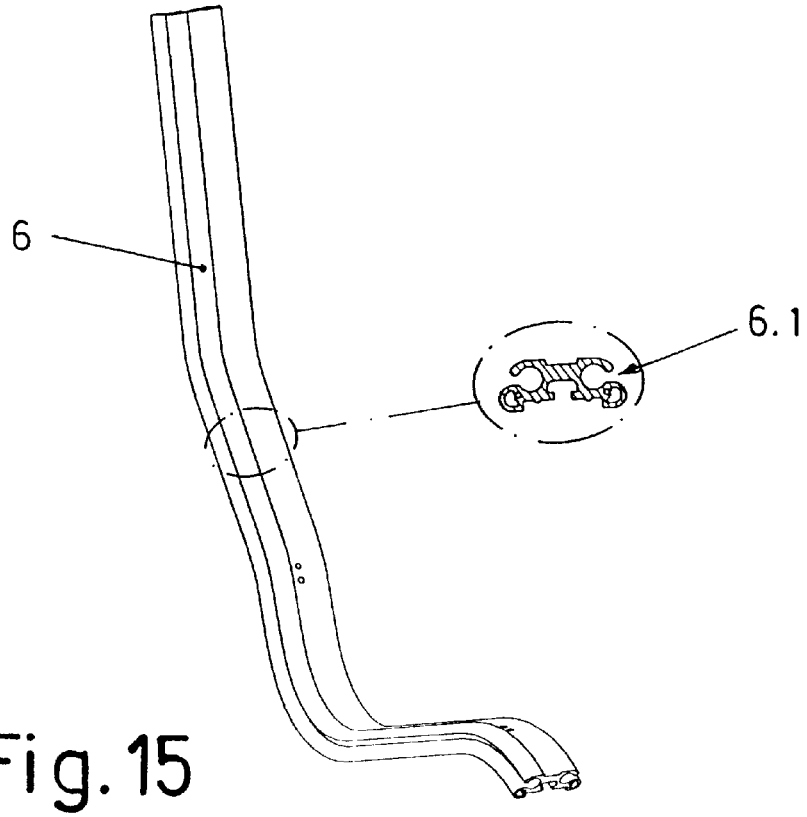
Figure 16:
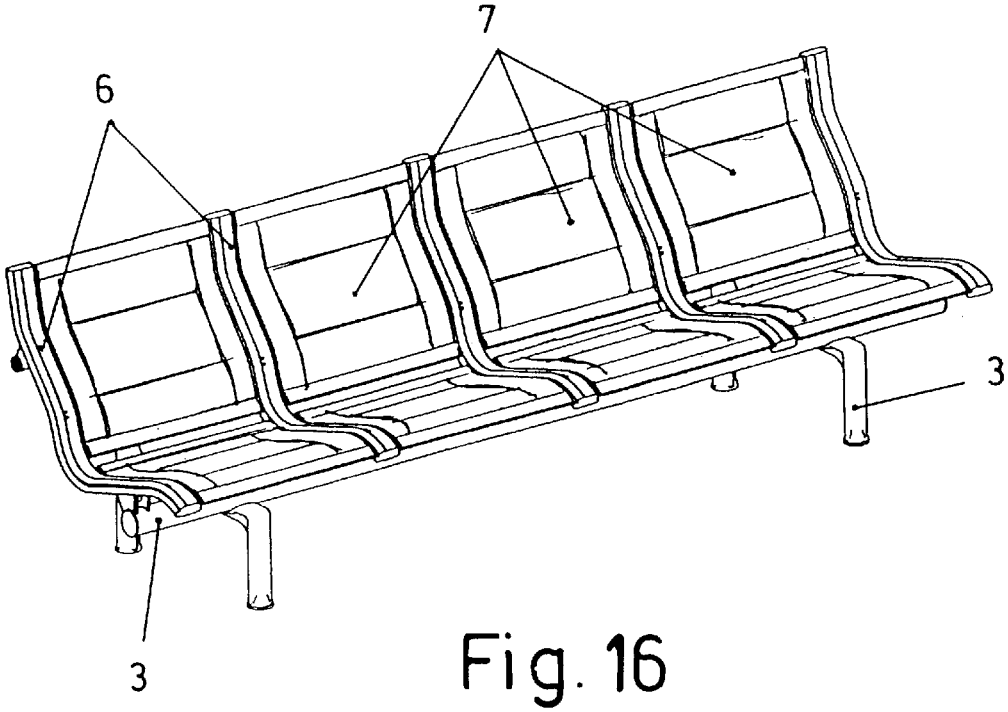
FIGS. 16 to 20 are drawings which depict different configuration examples of the cover of the block of seats.
Figure 17:
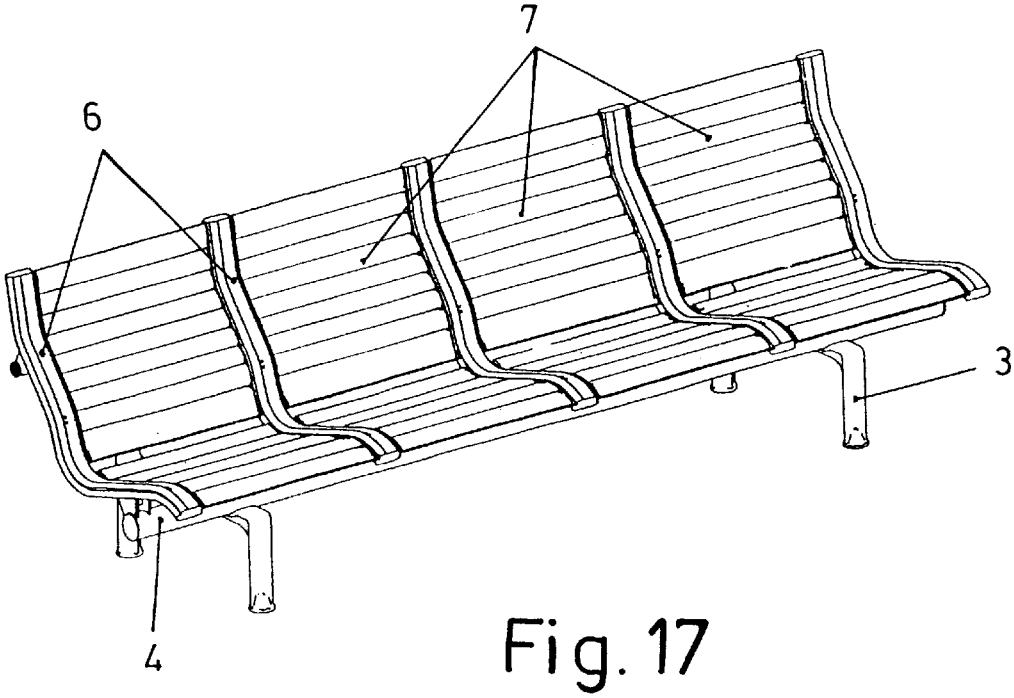
Figure 18:
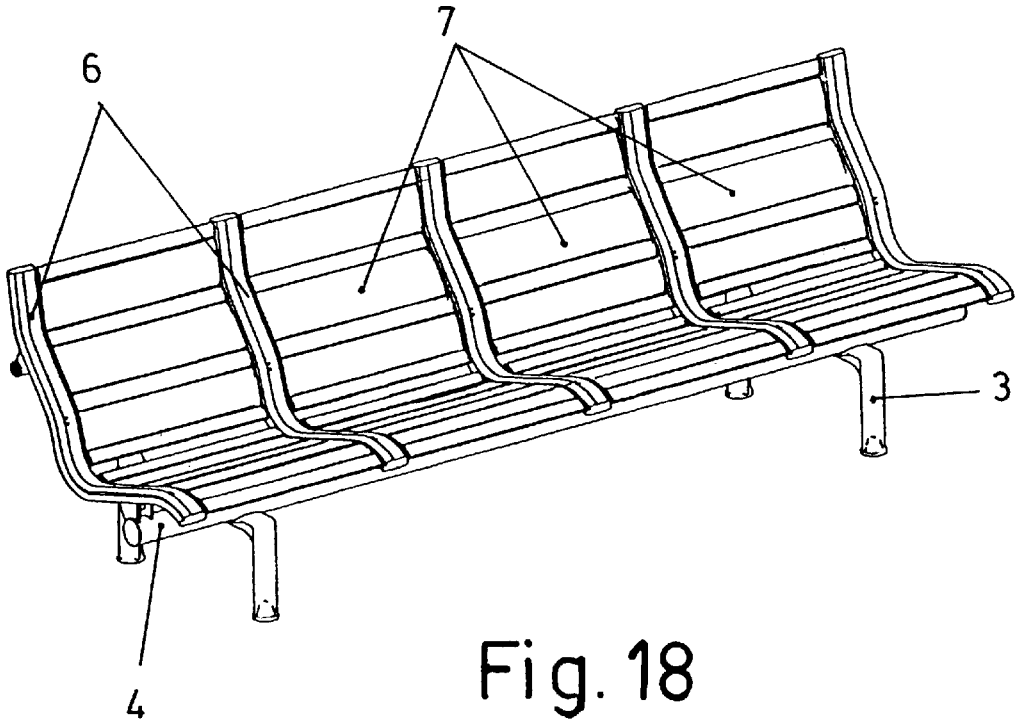

The core (8) of the laminar structures (7), is attached to PVC, or another synthetic material, ribs (11). The ribs (11) are fastened to profiles (6) by means of a sliding connection of a rib (11) in a grooved recess (6.1) of a profile (6), according to an assembly as the one represented on FIG. 12. The ribs (11) preferably present a circular transverse cross-section, which will correspond to the shape of the profile recess (6).

Figure 6:
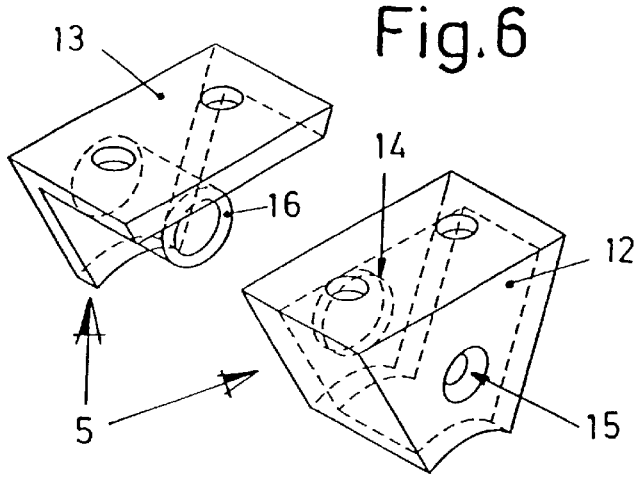
FIG. 6 is a drawing which depicts an exploded perspective of a two part fastening assembly according to the inventive block of seats.
Figure 7:
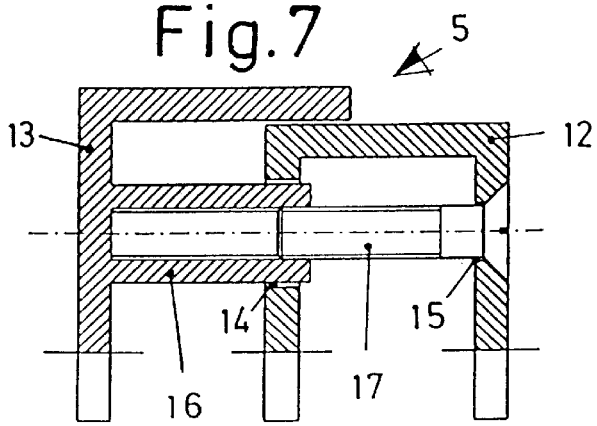
FIG. 7 is a drawing which depicts a sectioned side view of the fastening assembly in an early connection phase.
Figure 8:
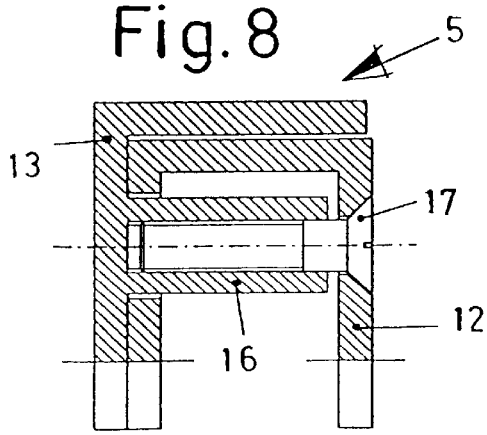
FIG. 8 is a drawing which depicts a sectioned side view of the fastening assembly in its final connection phase.

Fastening fittings (5) are made up according to FIGS. 6, 7, and 8, by complementary parts (12 and 13), a first part (12) fixed to a longitudinal beam (4) of the bearing structure (1), while a second part (13) is fixed to a profile (6) of the cover (2).

According to one aspect of the invention, the first part (12) is attached to the longitudinal beam (4) of the bearing structure (1), by a U-shaped structure through by-pass holes (14) and (15), while the second part (13) is attached to a profile (6) of the cover (2), by an L-shaped structure, fastening at one of its arms, while from the other arm, a hollow cylinder (16) extends perpendicularly at its inner part, from which a threaded inside comes out, and which can pass axially through one of the side holes (14) of the U-shaped first part (12).

By means of a fastening fitting (5), the connection is established by the insertion of the cylinder (16) of the second part (13) through the side hole (14) of the first part (12), including through the hole (15) of the first part (12). A screw (17), is inserted in threaded union with respect to the cylinder (16) of the second part (13).

As shown in FIGS. 7 and 8, by means of threading the screw (17), movement takes place between parts (12) and (13) until the desired fastening torque is reached. The movement of parts (12) and (13) is guided by the sliding of the cylinder (16) through the hole (14), which eases up the assembly. Once the cylinder (16) of each fitting (5) is headed in the corresponding hole (14), the set is maintained by itself in the correct assembly position, it being necessary only to tighten the screws (17) for the fastening, so that to carry out the tightening, the whole set adopts the appropriate position by itself.

A exemplary assembly is started with one fixed profile (6) and inserting seat and backrest sections of the cover (2) in it and a second profile (6), so as to later arrange the second profile (6) in assembly disposition, where the cylinder passage (16) of the second part (13) passes through the hole (14) of the first part (12). In this disposition, the screw is (17) turned until the correct torque on the seat and back sections is reached. This degree of tightening is limited by the reciprocal stop between parts (12) and (13).

A seat module is installed in this way, and in the same way for each following module, making use of the corresponding free profile (6) of the previous module.

It is clear that the fastening means made up by parts (12) and (13) can vary without altering the essence of the invention, since any fastening solution which allows a progressive tightening will be effective. Also, the cross-section of the profiles (16) can adopt different forms, as the two housings (6.1) guide the insertion of the ribs (11) of each laminar structure (7).

In figures (14) and (15) two non-limiting examples of the shape of the profiles (6) are shown.

It has to be pointed out that during assembly, the progressive approach that takes place of parts (12) and (13), gives rise to a controlled stretching of the laminar structure (7) of the surface closure, as part (13) hauls the corresponding profiles (6) and these pull the sides of the laminar structures (7), producing tightening until parts (12) and (13) are in contact with one another.

Nevertheless, the stretching that the profiles (6) exercise on the laminar structures (7) is only exercised on the core (8), as the side ribs (11), which produce the pulling effect, are only joined by the core (8), which is thus the structure which produces the effort, without affecting either the soft material layer (9) or the external cover (10), which could be damaged. In this manner, seams are welded at high frequency, without the soft (9) layer and the external cover (10) being affected by the tightening of the laminar structures (7). What is more, the seams can be in any direction: horizontally, in the direction of tensioning, vertically, on a bias, or any combination of these, as shown on the attached figures, thus giving rise to multilineal shapes.

In any case, so as to avoid deforming the upper and lower edges of the laminar structures (7) produced by tightening, some reinforcements (18) are incorporated on the edges, which avoid the distortion.

In another aspect, the laminar structures (7) which determine the seat and back-rest surfaces can adopt any external appearance, for instance according to the non-limiting examples shown in FIGS. 3, 14, 15, 16, 17 and 18. It is also contemplated that the seat and the back-rest of each module are a unique laminated part (7).

Figure 19:
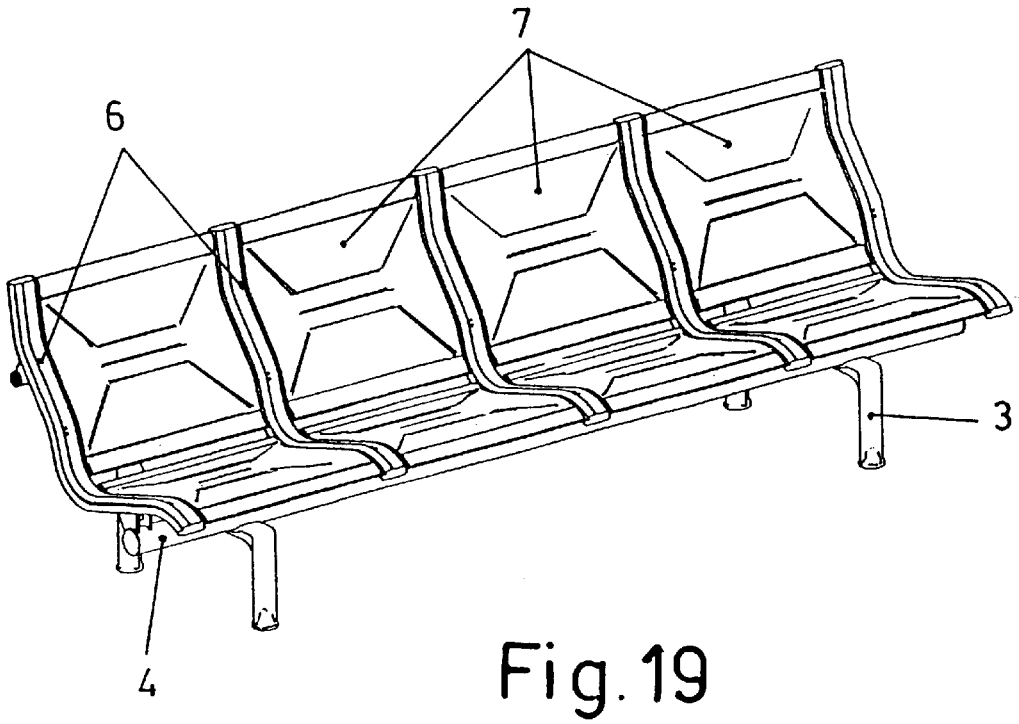
Figure 20:
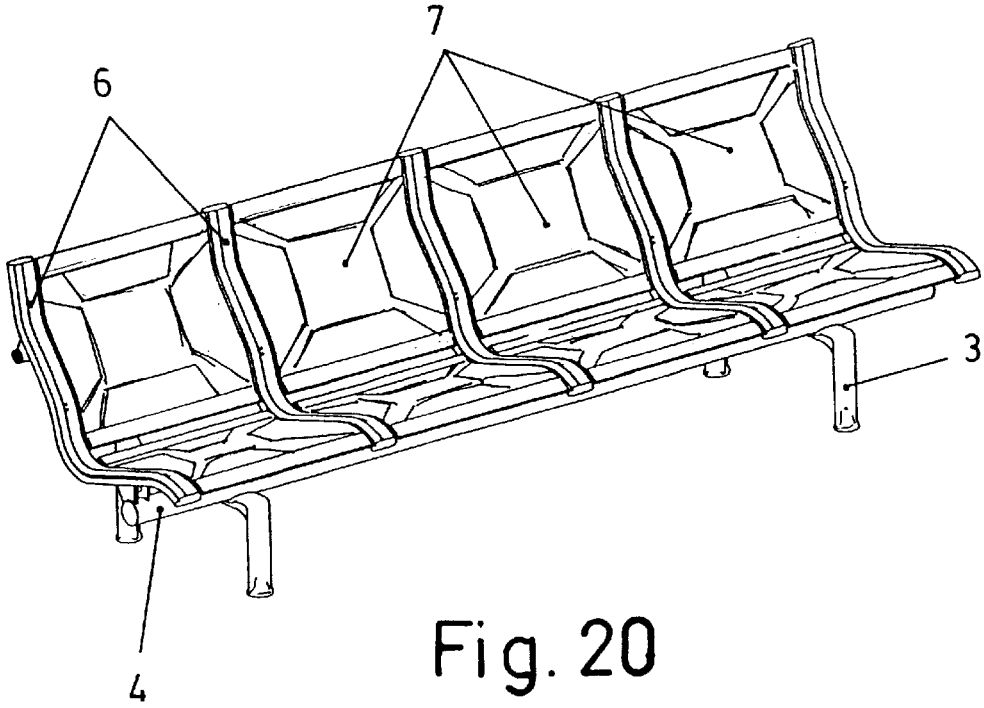
Figure 21:
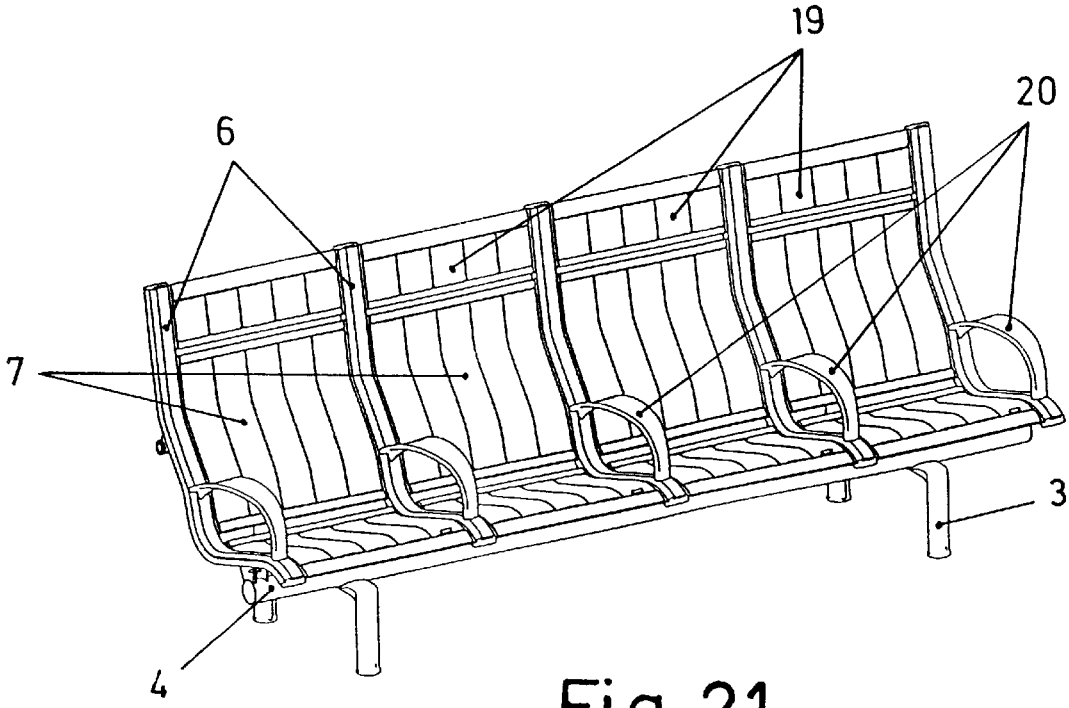
FIG. 21 is a drawing which depicts a perspective view of an embodiment of the block of seats with arm-rests and head supports

Similarly, without modifying the structural concept, the seat block can include a relief (19) in the back-rests, having the function of head-support, as well as elements (20) between the seat and the back-rest areas, having an arm-rest function, as shown in FIG. 19. These arm-rests (20) are attached to the profiles (6).

The head-rests (19) would be mounted with the same concept of the seat and backrest.

As discussed above, the profiles (6) can adopt different traverse sections (6.1) for the assembly of the ribs (11). In this sense, and according to the example shown in FIG. 15, the profiles (6) allow for the sliding and guiding assembly to use nuts for fastening between the profiles (6) and the fittings (5); these nuts can also be directly attached to the profiles (6) at the points where they are needed.

Figure 22:
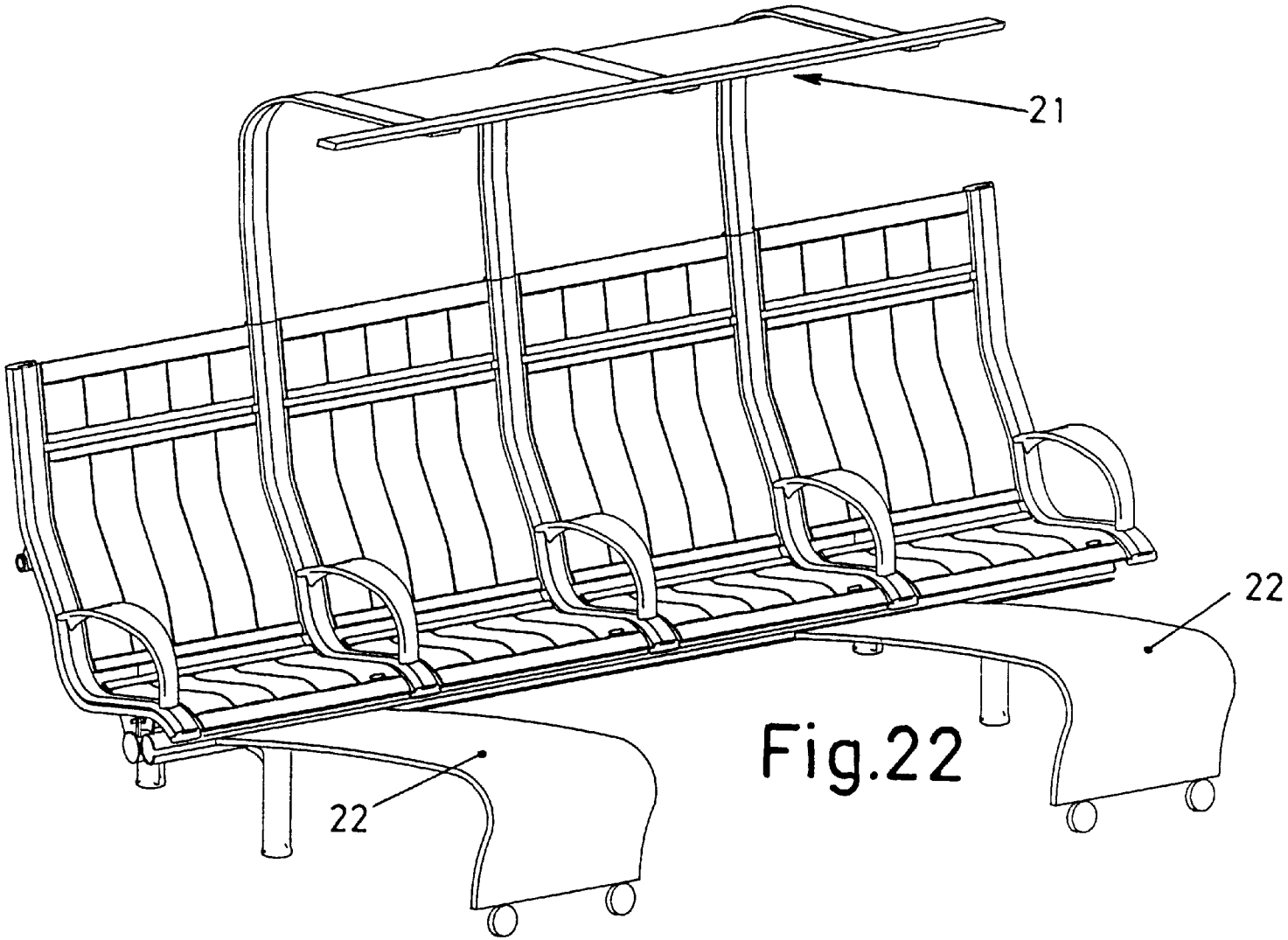
FIG. 22 is a drawing which depicts another perspective view of an embodiment of the block of seats showing a variant of the practical realization.

For example, as shown in FIG. 22, the block of seats is supplemented with an upper structure (21) to hold suitcases, with locking means so as to avoid inadvertently moving the suitcases through the rear, and to incorporate lights for the seat user. Foot-supports (22), mounted with the possibility of horizontal movement through sliding guides joined to the seat front and supporting wheels on the foot-supports (22) themselves, are also contemplated.

The essence of the present invention contemplates laminar structures (7) which make up the seat and the back-rest of each section of the block, are mounted between a pair of profiles (6) which are separated progressively, in a controlled and guided movement, during the assembly of the block to provide tensioning of the laminar structures (7), and a resistant core (8) which remains connected to the profiles (6) through side ribs (11). The general configuration and performance of the block of seats can vary without modifying the essential character of the invention.

What is claimed is:

1. A block of seats for airports, comprising:

(a) a bearing structure which has a plurality of supports in the form of legs, (b) at least two horizontal longitudinal beams, which are attached to said bearing structure, (c) a cover made up of sections which determine consecutive seat and back-rest surfaces, respectively, and which are situated on said horizontal longitudinal beams, wherein each cover section is made up of one or several laminar structures mounted between a pair of extruded profiles, wherein said extruded profiles are mounted to the horizontal longitudinal beams through sets of fittings, and wherein said extruded profiles establish a guide during the assembly of the block, and later establish a progressive separation between the extruded profiles of each section, to give rise to a tensioning of the laminar structures.

2. The block of seats according to claim 1, characterized in that each laminar structure is made up of a tough core material, having a soft core and a protective covering which accompanies it, wherein said tough core material is connected to said profiles, and on which material the tensioning is carried out, so that the tensioning does not affect the cover.

3. The block of seats according to claim 1, characterized in that, each set of fittings is made up of two parts, wherein a first part is fixed to a longitudinal beam and a second part is fixed to an extruded profile establishing a connection between these parts which gives rise to a positioning guide for each profile during assembly, and wherein a connection is established between the first and second parts which allows progressive separation between the profiles until reaching a previously determined final position defined by a stop between the first and second parts.

4. The block of seats according to claim 3, characterized in that for each set of fittings, a first part is fastened to a longitudinal beam of the bearing structure while a second part is fastened to a profile, wherein the first and second parts have reciprocal connection shapes, between which a sliding guide is established, wherein a screw fastening determines the relative movement between the first and second parts, and wherein the tensioning of the laminar structures of the covering sections is carried out by traction on the tough braided layer between profiles.

5. The block of seats according to claim 1, characterized in that each laminar structure comprises:

(a) a tough braided layer, (b) a soft core material, and (c) a synthetic cover material, covering the soft core material on two sides, wherein the tough braided layer is attached at an edge of the laminar structure to ribs of synthetic material, and wherein a laminar structure is connected to a profile through a sliding connection between a rib and a corresponding grooved recess in a profile.

6. The block of seats according to claim 1, characterized in that for each set of fittings, a first part is fastened to longitudinal beam of the bearing structure, while a second part is fastened to a profile, wherein the first and second parts have reciprocal connection shapes, between which a sliding guide is established, wherein a screw fastening determines the relative movement between the first and second parts, and wherein the tensioning of the laminar structures of the covering sections is carried out by traction on the touch braided layer between profiles.

* * * * *

UNITED STATES PATENT AND TRADEMARK OFFICE

CERTIFICATE OF CORRECTION

PATENT NO. : 6,676,211 B1
DATED : January 13, 2004
INVENTOR(S) : Figueras Mitjans It is certified that error appears in the above-identified patent and that said Letters Patent is hereby corrected as shown below:

Column 5,
Line 22, change “the tough” to -- a tough --.

Column 6,
Lines 13-14, change “fastened to longitudinal” to -- fastened to a longitudinal --.
Line 22, change “touch” to -- tough --.

Signed and Sealed this

Twenty-fourth Day of February, 2004

JON W. DUDAS
*Acting Director of the United States Patent and Trademark Office*